US005622414A

United States Patent [19]

Artwohl et al.

[11] Patent Number: 5,622,414

[45] Date of Patent: Apr. 22, 1997

[54] REFRIGERATOR DISPLAY CABINET WITH THERMALLY INSULATED PIVOTABLE ALL GLASS FRONT WINDOW PANEL

[75] Inventors: Paul J. Artwohl, Flossmoor; Andrew G. Menke, Orland Park, both of Ill.

[73] Assignee: Ardco, Inc., Chicago, Ill.

[21] Appl. No.: 73,124

[22] Filed: Jun. 7, 1993

[51] Int. Cl.[6] ..... A47F 3/04

[52] U.S. Cl. ..... 312/116; 312/139; 312/319.2; 312/328; 49/40; 49/340; 49/368; 49/489.1; 49/501

[58] Field of Search ..... 312/116, 138.1, 312/139, 319.2, 328; 49/40, 340, 368, 489.1, 501

[56] References Cited

U.S. PATENT DOCUMENTS

| | | | |
|---|---|---|---|
| 1,630,160 | 5/1927 | Bayless . | |
| 1,744,070 | 1/1930 | Deacon | 312/116 |
| 1,897,957 | 2/1933 | Rossebo et al. | 312/116 |
| 2,648,584 | 8/1953 | Morton . | |
| 2,790,213 | 4/1957 | Smith . | |
| 2,811,406 | 10/1957 | Moore et al. . | |
| 3,070,852 | 1/1963 | Hilliker . | |
| 3,101,227 | 8/1963 | Puch . | |
| 3,466,801 | 9/1969 | Bohn . | |
| 3,768,206 | 10/1973 | Lingle . | |
| 4,223,482 | 9/1980 | Barroero et al. . | |
| 4,801,180 | 1/1989 | Styles | 312/116 |
| 4,831,780 | 5/1989 | Bockwinkel . | |
| 4,842,349 | 6/1989 | Stenemann | 312/116 |
| 4,891,912 | 1/1990 | Bockwinkel . | |
| 5,024,023 | 6/1991 | Kostos et al. | 49/501 |
| 5,116,274 | 5/1992 | Artwohl et al. | 312/116 |
| 5,161,329 | 11/1992 | Brown . | |
| 5,207,490 | 5/1993 | Kaspar et al. | 312/139 |

FOREIGN PATENT DOCUMENTS

| | | | |
|---|---|---|---|
| 2482909 | 11/1981 | France | 312/139 |

*Primary Examiner*—Edward K. Look
*Assistant Examiner*—Christopher Verdier
*Attorney, Agent, or Firm*—Leydig, Voit & Mayer, Ltd.

[57] ABSTRACT

A refrigerator display case having a plurality of insulated glass window panels mounted in side-by-side relation for pivotal movement about an upper horizontal pivot axis. Each of the window panels has a substantially all glass front appearance, unencumbered by external hardware, trim or moldings. To achieve such appearance, the upper spacer element of the window panel is in the form of a pivot bar completely concealed by an outer glass pane of the panel, but which has an exposed underside mounting surface to which a hinge plate is connected. Each window panel has side sealing members secured to respective side spacers and with a blade portion extending outwardly from the peripheral edges of the glass panes of the window panel for side-by-side sealing engagement with the side sealing members of adjacent window panels when the window panels are in a closed position. Such side sealing members permit the window panels to be mounted in relatively closely spaced adjacent relation, further contributing to the all glass appearance of the panels.

26 Claims, 4 Drawing Sheets

REFRIGERATOR DISPLAY CABINET WITH THERMALLY INSULATED PIVOTABLE ALL GLASS FRONT WINDOW PANEL

FIELD OF THE INVENTION

The present invention relates to refrigerator display cabinets, and more particularly, to refrigerator display cabinets of the type that are used in supermarkets, butcher shops and the like for cooling and displaying food products and which include a plurality of front window panels hinge mounted in side-by-side relation along the length of the cabinet.

BACKGROUND OF THE INVENTION

Display cabinets of such type typically have an elongated hollow configuration within which the food products are contained and a plurality of window panels each extending forwardly and downwardly in curved fashion from a top of the cabinet for enclosing the front of the cabinet while permitting viewing of refrigerated food products and the like within the cabinet by passing customers. It is known to clamp the upper peripheral edge of each window panel in a respective hinge assembly and to utilize fluid controlled cylinders or springs to facilitate pivotal movement of the window panel between a lowered, closed position and an upwardly raised, open position that permits access to the interior of the cabinet from the customer side in order to facilitate refilling of the cabinet with goods and cleaning of the cabinet interior.

Because thermal efficiency and energy costs are important considerations in operating commercial refrigeration units, it is desirable that the window panels in such display cabinets each comprise a thermally insulated glass unit made up of two or more glass panes that are supported in spaced apart relation with the interior between the panes appropriately sealed. Because the insulated glass units are heavy, the hinge mounted clamps along the upper peripheral edge of the panel have been relatively massive and distract from the aesthetic appearance of the cabinet. Because of the mass and weight of the window panels, the upper marginal edge regions of the panels also are susceptible to damage by the hinge clamps during usage.

Thermal efficiency considerations further require that the window panels effectively seal the interior of the refrigerator cabinet from the outside environment when the panels are in their closed positions. Heretofore, problems have been incurred in providing effective and aesthetic seals between sides of adjacent window panels when in their closed positions. Moldings have been used which are positioned over respective side marginal edge regions of the panels, such that when the panels are in a closed position gaskets supported by moldings of adjacent panels are in engaged in relation to each other. Such moldings, which surround and encompass the side of the window panels, can be unattractive and old-fashioned in appearance, and as a result of repeated opening and closing of the window panels in commercial establishments, can become loosened and dislodged from the window panel and protrude outwardly from the side of the panel to the extent that they interfere with proper closing of the window panel. While mullions can be provided to support sides of adjacent panels when closed and enhance side sealing, such moldings are costly, and when the window panels are in a raised condition, are unsightly and impede access to the interior of the cabinet.

To further enhance the aesthetic appearance of the window panels through which merchandise in the refrigerated cabinet is displayed, it is desirable that the hinge clamps, spacers, and other components of the insulated glass unit occupy relatively small marginal edge regions about the perimeter of the window panels so as to not obstruct or detract the viewing area. It is equally important that the air space between the window panes of the insulated glass unit be maintained moisture free for clear viewing, and for this purpose, it is desirable that sufficient desiccant be provided in a manner which does not adversely affect the appearance of the window panel.

It is an object of the present invention to provide a refrigerator display cabinet having a plurality of side-by-side mounted window panels each comprising a curved insulated glass unit that has a modernistic and clean appearance and which permits substantially unobstructed viewing of the interior of the refrigerator cabinet.

Another object is to provide a refrigerator display cabinet of such type in which the window panels each are hinge mounted for pivotal movement without the need for clamps which detract from the appearance of the window panel.

A further object is to provide a refrigerator display cabinet as characterized above in which no external hardware, hinge clamps, or moldings are visible when the window panels are in their closed position.

Yet another object is to provide a refrigerator display cabinet of the above kind in which the window panels have improved means for sealing adjacent sides of the panels when in a closed position, without the necessity for costly mullions that are unsightly and impede access to the interior of the cabinet.

Another object is to provide a refrigerator display cabinet in which the side seals are retained free of adhesives so as to permit removal and replacement.

Still another object is to provide a refrigerator display cabinet of such type in which the window panel side seals will not loosen to impede complete closing of the window panels and disruption of the seal between adjacent panels, even after repeated opening and closing of the window panel in commercial establishments.

Another object is to provide such a refrigerator display cabinet in which spacers and sealing means in the sides of the window panels occupy relatively narrow perimeter portions of the window panels so as to be substantially inconspicuous when the panels are in their closed position and enable the panel to have an all glass front appearance.

Other objects and advantages of the invention will become apparent upon reading the following detailed description and upon reference to the drawings, in which:

Figure 1:
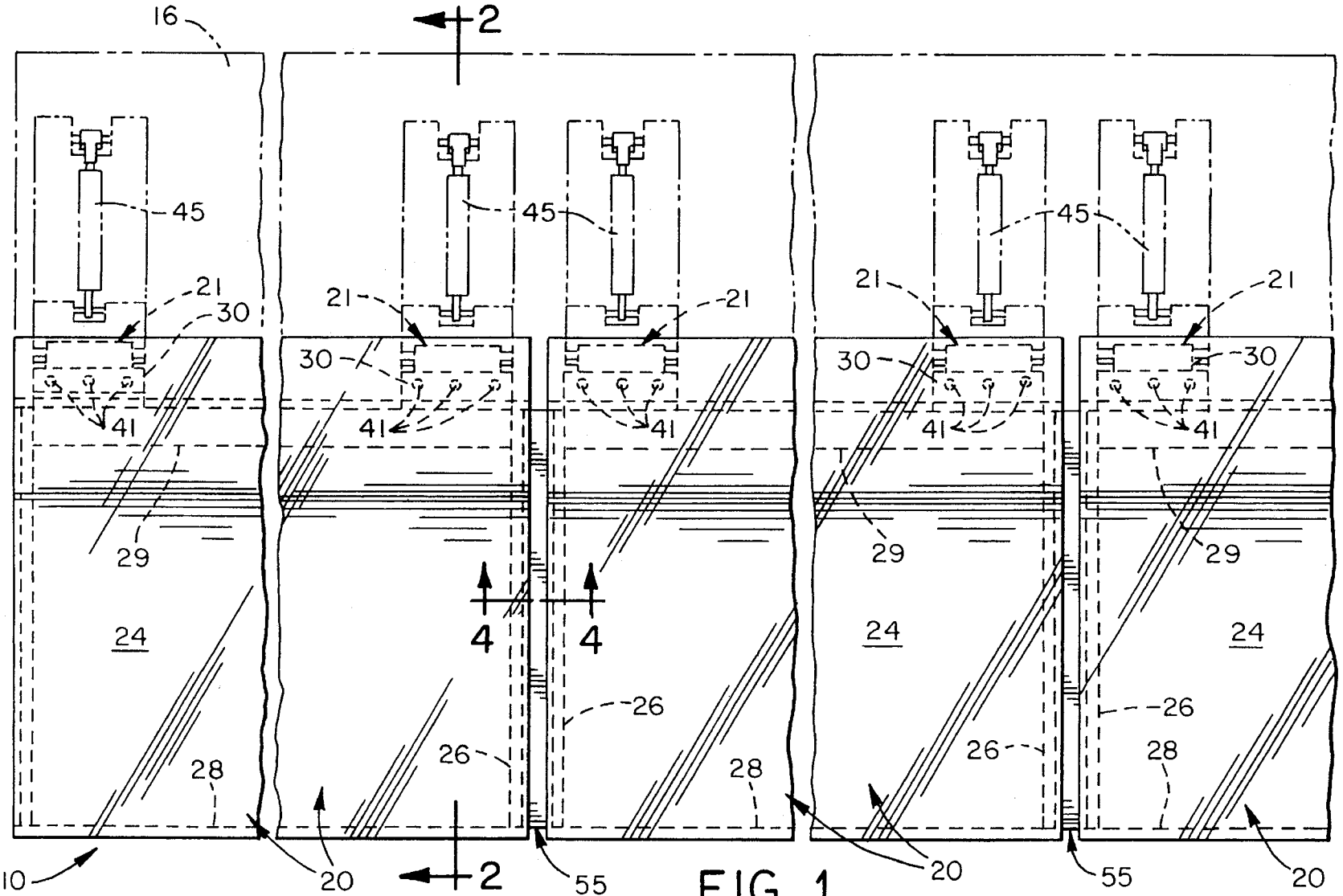
FIG. 1 is a top plane view of a refrigerator display cabinet embodying the present invention.
Figure 2:
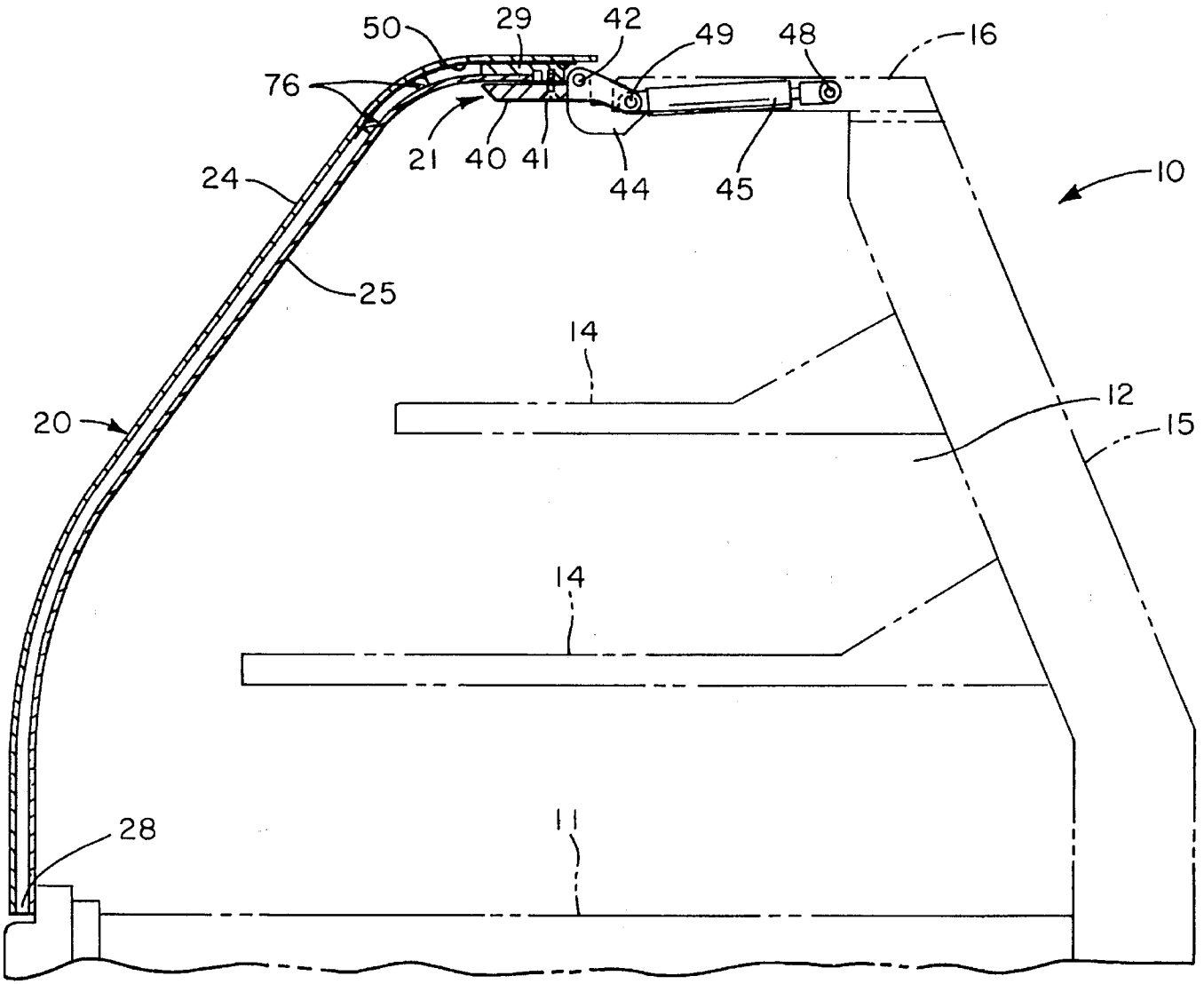
FIG. 2 is a fragmentary section taken in the plane of line 2—2 in FIG. 1, showing a window panel of the display cabinet in a closed position.

While the invention is susceptible of various modifications and alternative constructions, a certain illustrated embodiment thereof has been shown in the drawings and will be described below in detail. It should be understood, however, that there is no intention to limit the invention to the specific form disclosed, but on the contrary, the intention is to cover all modifications, alternative constructions and equivalents falling within the spirit and scope of the invention.

DESCRIPTION OF THE PREFERRED EMBODIMENT

Referring now more particularly to FIG. 1 of the drawings, there is shown an illustrative refrigerator display case 10 embodying the present invention. The display case 10 may be of a conventional configuration, comprising a lower cabinet section 11 for containing refrigeration means and an upper food containing cabinet section 12, in this case having a plurality of display shelves 14. The upper cabinet section 12 in this instance has a forwardly and upwardly inclined rear wall 15 on the service side of the display case 10 and a horizontal top wall 16 extending forwardly therefrom. To permit viewing of food products and the like contained within the cabinet, the display case 10 has a plurality of window panels 20 mounted in side-by-side relation along the length of the cabinet. For enabling access to the interior of the display case 10, the window panels 20 each are supported by respective pairs of hinge assemblies 21 that permit pivotal movement of the window panel 20 about a horizontal axis between a lowered, closed position and a raised, open position.

Each window panel 20 in this case comprises an insulated glass unit formed of a pair of outwardly and downwardly curved glass panes 24, 25 disposed in parallel side-by-side relation separated by a spacer. The spacer comprises a pair of curved side spacer elements 26 disposed adjacent opposite sides of the glass panes 24, 25, a lower horizontal spacer element 28, and an upper horizontal spacer element 29.

In accordance with an important aspect of the invention, the window panels each have a clean modernistic appearance, with the exterior surfaces thereof being unencumbered and free of unsightly moldings, clamps or external trim. To this end, the upper spacer element 29 of each window panel 20 is in the form of a pivot bar disposed between the glass panes 24, 25 for enabling pivotal movement of the window panel without the necessity for relatively massive, externally exposed clamps about the upper peripheral edge of the window panel 20. In the illustrated embodiment, the outer glass pane 24 is larger in size than the inner glass pane 25, and the pivot bar 29 extends the length of the window panel 20 in interpose relation between the inner and outer panes 24, 25. The pivot bar 29 has hinge mounting sections 30 extending rearwardly at opposite longitudinally ends thereof, the hinge mounting sections 30 being disposed beneath the outer glass pane 24 but rearwardly of a rear peripheral edge 25*a* of the inner pane 25. In this case, the rearwardly extending hinge mounting sections 30 of the pivot bar 29 have a thickness greater than the forward portion interposed between the glass panes 24, 25 so that exposed underside faces of the hinge mounting sections 30 are substantially flush with an underside face of the inner pane 25.

For establishing a primary seal between the pivot bar 29 and the glass panes 24, 25, a sealant 31, such as butyl, is provided between mating surfaces of the glass panes 24, 25 and the pivot bar 29. A secondary seal formed by a sealant, such as polysulfide, preferably encompasses a rear side of the pivot bar 29 along the length thereof between the hinge mounting sections 30. To provide secondary seals between the hinge mounting sections 30 and the glass panes 24, 25, the pivot bar 29 is formed with a recess 32 adjacent the peripheral edge of the inner glass pane 25 in which polysulfide is provided. Polysulfide similarly is provided in a pocket 34 defined by the underside of the outer glass pane 24 and bevels in the upper ends of the pivot bar hinge mounting sections 30.

In carrying out the invention, the hinge assemblies 21 each have a hinge plate 40 coupled to an underside exposed mounting surface of a respective window panel pivot bar mounting section 30 for pivoting the window panel 20 between open and closed positions. The hinge plate 40 of each hinge assembly 21 is positioned immediately against the underside exposed surface of the pivot bar 29 and is secured thereto by screws 41. The hinge plate 40 in this case has a forward end extending over the upper marginal edge region of the inner glass pane 25, sandwiching the upper marginal edge region of the inner glass pane 25 between the hinge plate 40 and the pivot bar 29. Sealant 43 also preferably is provided at the interface between the hinge plate 40 and the upper marginal edge region of the inner glass pane 25 and the pivot bar mounting sections 30. When the window panel 20 is in a closed position, such as shown in solid lines in FIG. 3, the pivot bar 29 and hinge plate 40 are substantially horizontally directed.

For permitting pivoting the hinge plate 40 and the window panel 20 secured thereto from a closed position (as depicted by solid lines in FIG. 3) to a raised position permitting access to the interior of the display cabinet (as depicted in phantom in FIG. 3), the hinge plate 40 is pivotally mounted on a hinge pin 42 supported by a bracket 44 fixed in forwardly extending relation to the upper wall 16 of the cabinet. To facilitate and control pivotal movement of the hinge plates 40 and the window panels 20 secured thereto, each hinge assembly 21 includes a pneumatic cylinder 45 mounted on the underside of the cabinet wall 16. Each cylinder 45 has a piston rod 46 connected for relative pivotal movement to a respective pivot pin 48 mounted on the underside of the cabinet hall 16 rearwardly of the hinge pin 42. Each cylinder 45 has its opposite end pivotally supported by a pivot pin 49 mounted on a rearwardly extending arm 40*a* of the hinge plate 40. It will be understood that the cylinders 45 may be of a conventional coil type or of a type having a self contained fluid for facilitating lifting and lowering of the window panel 20 in a controlled manner. Alternatively, the cylinders may be fluid actuated from an outside pneumatic or hydraulic source for exerting positive pivoting forces on the pivot hinge plate 40 when raising the window panel and for maintaining the window panel in a raised position.

Figure 3:
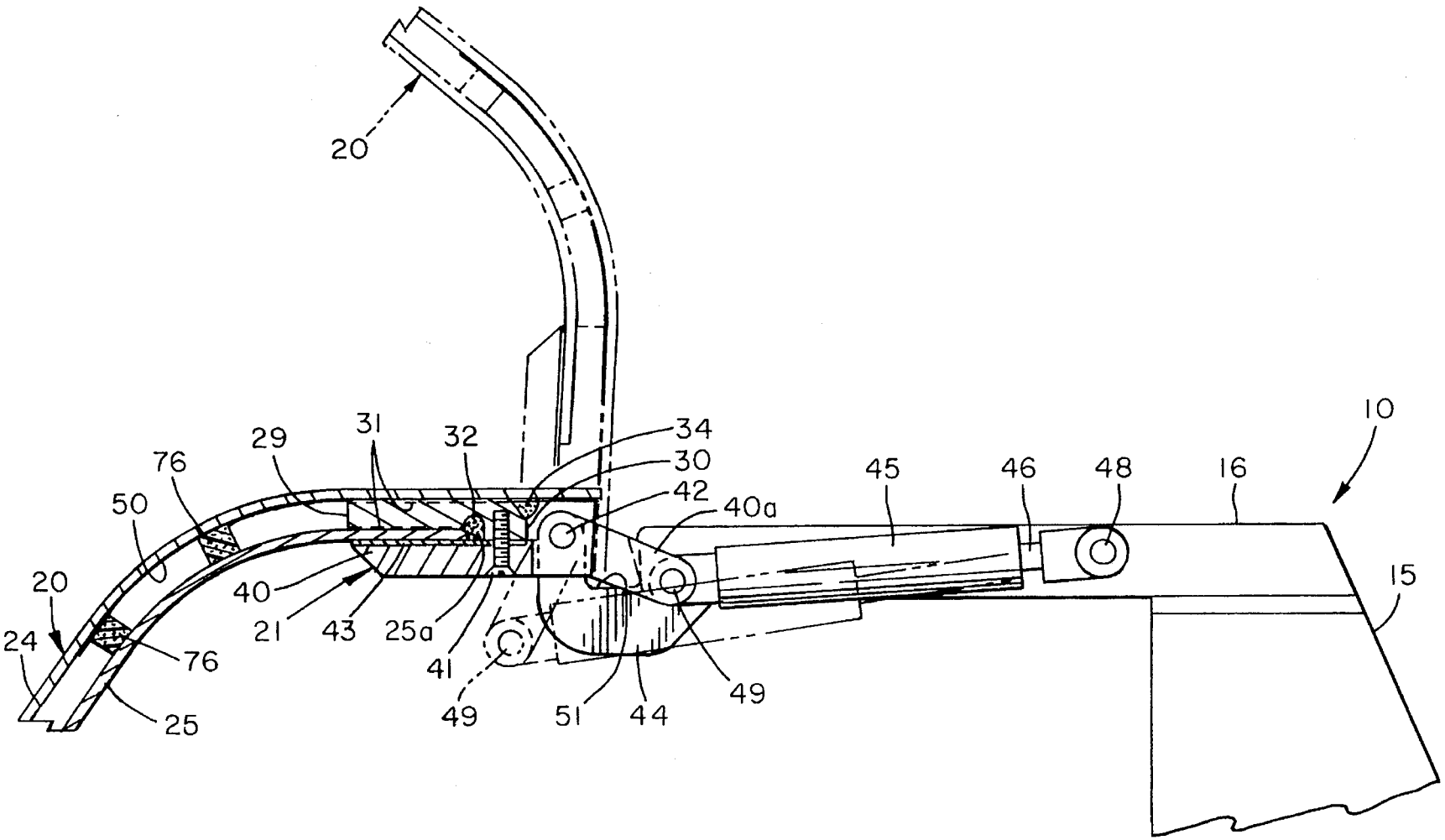
FIG. 3 is an enlarged fragmentary section of a hinge assembly for one of the window panels, showing the window panel in solid lines in a closed position and in phantom in a raised position.

In further carrying out the invention, the outer glass pane 24 of each window panel 20 extends rearwardly of the pivot bar 29 in overlapping relation to the hinge pin 42 and a silk screen masking 50, preferably a dark ceramic ink, is provided on the underside of the upper marginal edge region of the outer glass pane 24 for preventing viewing of the pivot bar 29, hinge plate 40, and hinge pin 42 and for providing the door with a clean, modernistic appearance free of exterior clamps, hardware or moldings. The outer glass pane 24 in this instance extends rearwardly to a point in closely adjacent relation to a forward end of the cabinet top wall 16 and the masking extends from a rear peripheral edge of the outer glass pane 24 forwardly and downwardly along a curve section of the outer glass pane 24 so as to also prevent viewing of the hinge assembly 21 from the front side of the window panel 20 when the window panel 20 is in its closed position. The hinge support bracket 44 in this instance is formed with an upwardly opening U-shaped recess 51 for providing clearance for movement of the rearwardly extending portion of the upper glass pane 24 during pivotal movement of the window panel to its raised position, as shown in FIG. 3.

Figure 4:
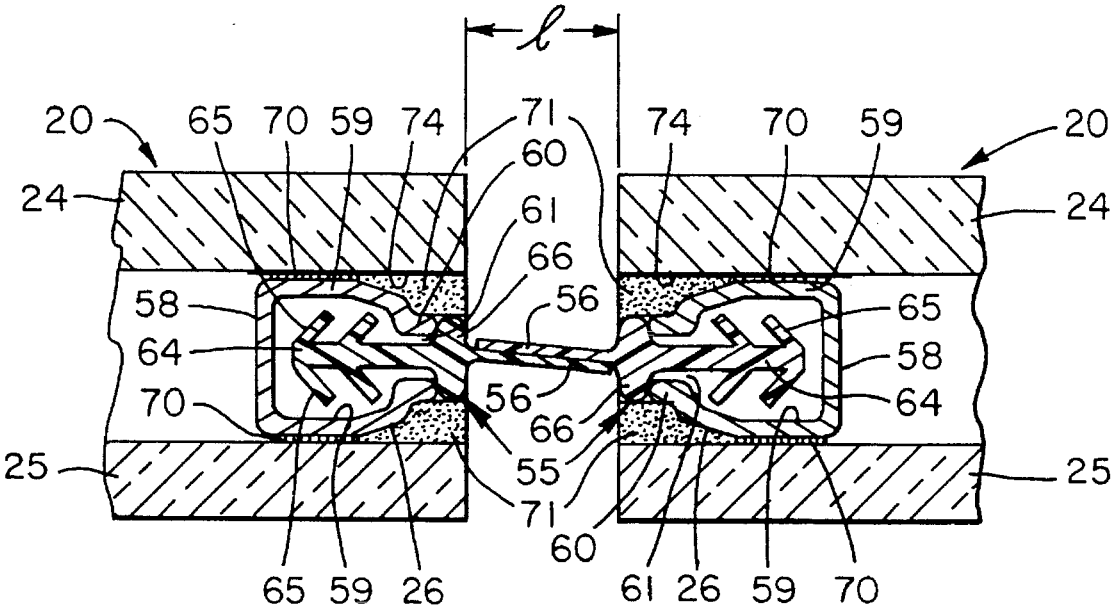
FIG. 4 is an enlarged fragmentary section of side sealing members of adjacent window panels in sealing engagement with each other, taken in the plane of 4—4 in FIG. 1.
Figure 5:
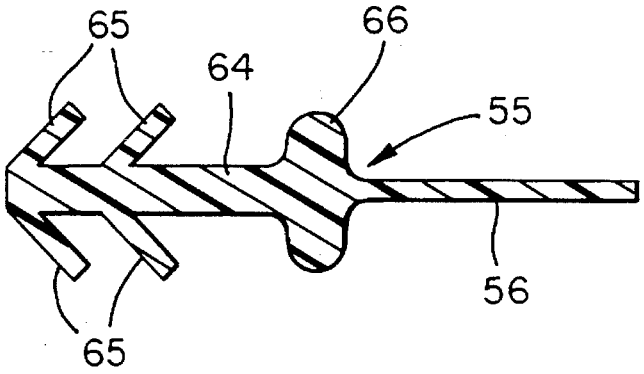
FIG. 5 is an enlarged section of one of the side sealing members.

In keeping with the invention, the window panels each have side sealing members 55 secured in a respective side spacer element 26 of the window panel 20 with a sealing portion 56 thereof extending outwardly from between the glass panes 24, 25 for overlapping sealing contact with the side sealing member of an adjacent window panel when the window panels 20 are in a closed position. In the illustrated embodiment, as best shown in FIGS. 4 and 5, the side spacer elements 26 each have an enlarged, tubular inner portion defined by an inner wall 58 and outwardly extending sidewalls 59 which establish the spacing between the glass panes 24, 25. The outwardly extending spacer sidewalls 59 terminate in a narrowed neck portion 60 which defines an outwardly opening seal receiving slot 61.

For mounting the side sealing member 55 in the side spacer 26, each side sealing member 55 has an anchor portion which includes an inwardly directed stem 64 having a plurality of resilient wings 65 on opposite sides thereof opening in the direction of the spacer slot 61. Such orientation of the wings 65, as will become apparent, facilitates downward bending of the wings 65 onto the stem 64 as the stem 64 is forced through the spacer slot 61 with the resilient wings 65 moving outwardly to their normal position after passage through the neck portion 60 of the spacer for securing the side sealing member 55 in the spacer 26. For seating the side sealing member 55 in proper position in the side spacer 26 and for closing and sealing the outwardly opening slot 61 of the spacer neck portion 60, each side sealing member 55 has an integrally formed locating and seating rib 66 intermediate its ends which seats on and closes the outer end of the spacer neck portion 60.

In further carrying out the invention, the outwardly extending sealing portion 56 of each side sealing member 55 is in the form of a substantially flat, resilient lip or blade. The sealing blade 56 preferably extends outwardly from the locating rib 66 a distance corresponding substantially to the distance lower case "1" between the peripheral edges of the glass panes 24, 25 of adjacent window panels 20 such that when the panels 20 are moved to their closed position, as depicted in FIG. 4, the sealing blades are forcefully moved into overlapping side-by-side engagement with sufficient force between the engaging blades as to effect a reliable seal therebetween, and hence prevent communication of air from the outside environment into the refrigerator cabinet.

To facilitate mounting of the sealing members 55 in the side spacers 26 while permitting enhanced sealing contact between the sealing blades 56 thereof, the sealing members 55 preferably are formed of extruded plastic with a dual durometer hardness. The stem 64 and locating and sealing rib 66 preferably are formed of rigid PVC plastic or the like, with a durometer hardness of about 75–80, in order to facilitate forceful insertion of the stem 64 through the spacer slot 61 during mounting and exact location of the sealing member in mounted position. The retention wings 65 and sealing blade 56, on the other hand, preferably are formed with a flexible plastic with a durometer hardness of about 65 so as to facilitate inward bending of the wings 65 as the stem 64 is forced through the spacer slot 61 during mounting and to ensure sufficient flexibility of the sealing blade 56 for reliable sealing engagement with the sealing blade of the adjacent window panel. While the wings 65 preferably are formed of relatively softer, and hence more flexible material, the angle of the wings toward the spacer slot 61 following mounting effectively resists accidental dislodgement of the sealing member 55 from its mounted position.

To provide a primary seal or vapor barrier between the side spacer 26 and the glass panes 24, 25, a butyl sealant 70 preferably is provided therebetween. A secondary seal 71 may be formed by polysulfide enclosing the areas defined between the spacer neck portion 60 and the adjacent surfaces of the glass panes 24, 25. For preventing viewing of the spacer 26 and sealants 70, 71 from outside the window panel 20 when in a closed position, a narrow width border of silk screen 74, again preferably of a dark ceramic type, is provided on the underside of the outer glass pane along its outer peripheral side. A similar narrow width, dark silk screen may be provided on the underside of the glass pane along the lower peripheral edge of the window panel, which may have a conventional tubular spacer, and when in a closed position, is positionable into sealing contact with an appropriate gasket on the cabinet.

It will be appreciated by one skilled in the art that the exterior surface of the window panel 20 is free of any moldings, clamps, or other hardware which detract from its clean appearance. The all-glass exterior appearance of the window panel, together with the dark silk screening about the perimeters thereof, provides the window panel with a highly modern appearance. Moreover, since the side sealing blades extend from the spacers along the sides of adjacent panels in overlapping relation to each other, the spacing between peripheral edges of glass panes of adjacent window panels is relatively small, further contributing to the substantially all-glass, mullion-free appearance of the cabinet.

It will further be appreciated that to maintain a vapor-free condition of the airspace between the glass panes, it is desirable that sufficient quantities of desiccant be provided in the window panel to accommodate the volume of airspace for the particular sized window panel. Since the side spacers 26 retain the side sealing members 55 and the upper spacer element 29 is in the form of a solid bar, these spacers cannot be utilized to contain desiccant in a conventional manner.

In carrying out a further aspect of the invention, one or more desiccant strips 76 are provided across the upper portion of each window panel 20 inwardly from the pivot bar 29, preferably in the upper curved portion thereof, and the silk screen masking 50 extends inwardly a sufficient distance to conceal the existence of such desiccant strips 76 from outside viewing. The desiccant strips 76 preferably are made of a conventional material, commercially available under the name "Super Spacer" by Edge Tech division of Lauren Manufacturing Co. The desiccant strips 76 preferably are of rectangular cross section and extend across the entire upper length of the window panel so as to both absorb moisture within the interior of the window panel 20, as well as assist in maintaining the glass panes 24, 25 in properly spaced relation to each other.

From the foregoing, it can be seen that the refrigerator display case of the present invention has window panels that have a modernistic all glass appearance free of external trim, moldings, or hardware. The window panel construction also permits opening and closing of the window panels without the necessity for massive externally exposed clamps which detract from the appearance of the cabinet and can damage the window panes. The side sealing members further enable the window panels to be mounted in closely spaced adjacent relation to each other, further contributing to the modernistic appearance of the display cabinet.

We claim:

1. A refrigerator display case comprising a cabinet for containing refrigerated items, said cabinet having a front opening, a plurality of window panels disposed in side-by-side relation, means supporting said panels for pivotal movement about a horizontal axis between a lowered position closing said cabinet opening and a raised position for permitting access to the interior of said cabinet through said opening, said panels each having an outer glass pane and inner glass pane, said glass panes of each panel being disposed in side-by-side relation with a spacer interposed therebetween for maintaining said glass panes in parallel relation with an air space therebetween, said spacer of each panel including a pair of side spacer members disposed between said glass panes adjacent opposite peripheral sides of the glass panes and upper and lower spacer members disposed between the glass panes adjacent upper and lower peripheral ends thereof, said upper spacer member being in the form of a pivot bar disposed partially between said outer and inner glass panes, said pivot bar having at least one hinge mounting section disposed below said outer glass pane but extending beyond the upper peripheral end of said inner glass pane so as to define an exposed mounting surface, and said panel supporting means including at least one hinge assembly for each panel, and said hinge assembly having a pivotally mounted hinge plate secured to said exposed mounting surface of said pivot bar hinge mounting section, including a side sealing member secured to at least one side spacer member of each window panel with a sealing portion extending outwardly from between the glass panes beyond side peripheral edges of the glass panes of the panel for side-by-side sealing engagement with the side sealing member of an adjacent panel when said panels are in the closed position.

2. The refrigerator display case of claim 1 in which said outer glass pane is larger in size than said inner glass pane.

3. The refrigerator display case of claim 2 in which said cabinet includes a top wall, means defining a hinge plate pivot axis in predetermined relation to said top wall, and said outer glass pane extends rearwardly over the upper peripheral end of said inner glass pane, said pivot bar mounting section, and said pivot axis when said window panel is in the lowered closed position.

4. The refrigerator display case of claim 1 in which said outer glass pane of each window panel has a completely exposed and unobstructed outer surface free of molding, hinge hardware and external trim.

5. The refrigerator display case of claim 4 in which the outer glass pane of each window panel has masking means about peripheral marginal edge regions thereof for preventing viewing of said spacer when in the closed position while permitting substantially unobstructed viewing of the interior of the refrigerator cabinet.

6. The refrigerator display case of claim 1 including fluid controlled cylinder means connected between said hinge plate and said cabinet for facilitating and controlling movement of each panel between said lowered and raised positions.

7. The refrigerator display case of claim 1 in which said pivot bar includes rearwardly extending hinge mounting sections at opposite ends thereof.

8. The refrigerator display case of claim 7 in which said pivot bar hinge mounting sections have a greater thickness than the portion of the pivot bar disposed between said glass panes such that an underside exposed mounting surface of said hinge mounting sections are substantially flush with an inner surface of the window panel.

9. The refrigerator display cabinet of claim 8 in which said pivot plate has a forwardly extending portion overlapping an upper marginal edge region of the inner glass pane.

10. The refrigerator display case of claim 1 including at least one strip of moisture absorbing desiccant extending across each window panel between the glass panes at a location inwardly of said pivot bar.

11. The refrigerator display case of claim 1 in which said spacer bar is a solid bar.

12. The refrigerator display case of claim 1 in which each said side sealing member has a portion extending outwardly from the peripheral side edges of the glass panes a distance corresponding substantially to a spacial separation between the peripheral edges of the glass panes of adjacent window panels.

13. The refrigerator display case of claim 1 in which said outwardly extending sealing portion of said side sealing member is in the form of a substantially flat-sided blade, and the flat-sides of sealing members of adjacent window panels are in mating engagement with each other when said panels are in the closed position.

14. The refrigerator display case of claim 13 in which said side sealing member has an anchor portion secured within the side spacer member of the panel.

15. A refrigerator display case comprising a cabinet for containing refrigerated items, said cabinet having a front opening, a plurality of window panels disposed in side-by-side relation with a side of one panel in closely spaced relation to a side of an adjacent panel, means supporting said panels for pivotal movement about a horizontal axis between a lowered position closing said cabinet opening and a raised position for permitting access to the interior of said cabinet through said opening, said panels each including a pair of glass panes disposed in side-by-side relation with a spacer interposed between said panes for maintaining said panes in parallel relation with an air space therebetween, said spacer including a pair of side spacer members disposed between said glass panes adjacent opposite peripheral sides thereof and upper and lower spacer members disposed between said glass panes adjacent upper and lower peripheral ends thereof respectively, and a side sealing member secured to at least one side spacer member of each window panel with a sealing portion extending outwardly from between the glass panes beyond side peripheral edges of the glass panes of the panel for side-by-side sealing engagement with the side sealing member of an adjacent panel when said panels are in the closed position.

16. The refrigerator display case of claim 15 in which each said side sealing member has a portion extending outwardly from the peripheral side edges of the glass panes a distance corresponding substantially to a spacial separation between the peripheral edges of the glass panes of adjacent window panels.

17. The refrigerator display case of claim 15 in which said outwardly extending sealing portion of said side sealing member is in the form of a substantially flat-sided blade, and the flat-sides of sealing members of adjacent window panels are in mating engagement with each other when said panels are in a forward closed position.

18. The refrigerator display case of claim 15 in which said side sealing member has an anchor portion secured within the side spacer member of the panel.

19. The refrigerator display case of claim 18 in which said sealing member anchor portion has a higher durometer hardness than said sealing portion.

20. The refrigerator display case of claim 18 in which said side spacer member has an outwardly directed opening through which said side sealing member extends, and said anchor portion includes a stem with integrally formed resilient wings extending outwardly of said stem at an acute angle thereto directed toward said side spacer opening for preventing withdrawal of the sealing member from the side spacer.

21. The refrigerator display case of claim 20 in which said anchor stem has a greater durometer hardness than said wings and said sealing portion.

22. The refrigerator display case of claim 20 in which said sealing member has an integrally formed locating and sealing rib intermediate the ends thereof for positioning against the side spacer member for locating the sealing member in predetermined position with respect thereto.

23. The refrigerator display cabinet of claim 15 in which said side spacer member has an enlarged tubular portion disposed between said panes for establishing the spacial separation therebetween and a narrow width neck portion extending outwardly from the tubular portion for defining a slot within which said side sealing member is disposed.

24. The refrigerator display case of claim 23 in which said side sealing member has an integrally formed locating rib intermediate its ends positioned adjacent the end of said spacer member neck portion covering the slot therein.

25. The refrigerator display case of claim 15 including sealing means between said spacer and glass panes for sealing the interior space between the panes of each panel from the outside environment, and masking means about a perimeter portion of said glass panes for preventing viewing of said spacer from a front side of said window panel when in the lowered closed position.

26. The refrigerator display case of claim 15 in which said outwardly extending sealing portion of said side sealing member is in the form of a substantially flat-sided blade, and each said side sealing member extends outwardly from the peripheral side edges of the glass panes a distance corresponding substantially to the spacial separation between the peripheral edges of the glass panes of adjacent window panels.

* * * * *